United States Patent [19]

Miyatuka

[11] 4,072,522

[45] Feb. 7, 1978

[54] METHOD OF TREATING PHOTOCONDUCTIVE ZINC OXIDE

[75] Inventor: Hajime Miyatuka, Asaka, Japan

[73] Assignee: Xerox Corporation, Stamford, Conn.

[21] Appl. No.: 741,588

[22] Filed: Nov. 15, 1976

Related U.S. Application Data

[63] Continuation of Ser. No. 583,074, June 2, 1975, abandoned, which is a continuation-in-part of Ser. No. 193,482, Oct. 28, 1971, abandoned.

[51] Int. Cl.[2] ..... G03G 5/08

[52] U.S. Cl. ..... 96/1.8; 252/501

[58] Field of Search ..... 96/1.8; 252/501; 423/627

[56] References Cited

U.S. PATENT DOCUMENTS

| | | | |
|---|---|---|---|
| 3,089,856 | 5/1963 | Gyr et al. | 252/518 |
| 3,378,371 | 4/1968 | Jarvis | 96/1.8 |
| 3,867,145 | 2/1975 | Honjo et al. | 96/1.8 |
| 3,897,248 | 7/1975 | Jabalpurwala et al. | 96/1.8 |

*Primary Examiner*—David Klein
*Assistant Examiner*—John L. Goodrow
*Attorney, Agent, or Firm*—James J. Ralabate; James P. O'Sullivan; Donald M. MacKay

[57] ABSTRACT

Electronic-photography light-sensitive material provided with a light-sensitive material layer suitable for rendering of continuous gradation of tones.

5 Claims, 2 Drawing Figures

METHOD OF TREATING PHOTOCONDUCTIVE ZINC OXIDE

This is a continuation, of application Ser. No. 583,074, filed June 2, 1975 now abandoned. And which is a continuation in part of Ser. No. 193,482 filed 10/28/71 and is now abandoned.

BACKGROUND OF THE INVENTION

This invention is a continuation-in-part of U.S. Ser. No. 193,482, filed Oct. 28, 1971 and relates to xerography and more specifically to a method of treating photosensitive zinc oxide in order to enhance its development characteristics.

In the art of xerography, a photosensitive member comprising a binder layer, such as zinc oxide particles dispersed in a film forming insulating resin, is uniformly electrostatically charged in the dark and then exposed to pattern of activating radiation to form a latent electrostatic image on the surface of the binder layer. This latent image may then be developed by immersing the photosensitive member in a liquid developing solution which contains toner particles. The toner particles are attracted to and adhere to the areas containing the latent electrostatic image. After removal from the developer bath, the photosensitive member is dried and the toner image fused to form a permanent reproduction of the original radiation pattern or image.

It is well known in the art of xerography that it is difficult to adjust the properties of a photosensitive layer to render it suitable for continuous tone reproduction when a photosensitive layer is imaged in the conventional sequence of charging, exposure and development with toner. In the art of photography, there are available photographic papers having grades designated No. 1 to No. 5 of silver salt having the characteristic curves for soft to hard tones. In electrophotography, however, the conventional photoconductor, such as photosensitive zinc oxide contained in a film forming insulating resin, is characterized by straight line in that the characteristic curve is shorter and the incline of the curve usually larger, which means harder. This characteristic curve is prepared by plotting the logarithm of the exposure strength on the abscissa and the relative residual potential or developer concentration at the ordinate. In general, no appreciable effect on the adjustment of the grading of the characteristic curve can be obtained in zinc oxide binder systems by changing such processing parameters as kneeding conditions, powder sizes, or the ratio of the resin to the photoconductor component.

To some extent the art has resorted to adjusting a wide range of such properties by utilizing two different kinds of zinc oxides having different light sensitivity. One kind of zinc oxide is used as a continuous layer and the other allowed to be distributed over said layer in a spotted manner to create a light sensitive layer. This concept is more fully described in U. S. Pat. No. 3,003,870. Similarly, the art has also resorted to using laminated coatings of several light sensitive component layers, one upon the other, of different spectrum sensitivity in order to otain enhanced electrical response. This concept is more fully described in British Patent Specification 967,690.

Notwithstanding the above, these techniques, suggested by the prior art, involve the necessity of coating a plurality of times in order to attempt to improve the electrical characteristics of zinc oxide binder systems.

It can be seen from the prior art, that complicated manufacturing processes, requiring much labor and resulting in lower efficiency in production, are required in order to attempt to obtain photoreceptors exhibiting a soft characteristic suitable for continuous tone reproduction. Accordingly, the use of the conventional techniques described above still render it difficult to prepare photoreceptor, such as the zinc oxide binder type, which exhibits tone characteristics soft enough to meet the requirements for continuous tone reproduction.

In using a photosensitive member which comprises zinc oxide contained in a film forming insulating resin, it is well known that zinc oxide must be used only with negative charging in that it has poor acceptance for positive charge. Accordingly, such a photosensitive layer must use a converted developing polarity in changing an original image from a positive to negative because of such a limitation. It is therefore required to employ during the developing method, a developer toner which floats electrically into the electrostatically latent part of the image for positive development, and then is developed (reversal development) by depositing toner provided with the same polarity of that of the latent electrostatic image. It is necessary in positive development of zinc binder layers to use a development liquid having a positive polarity, and for negative development (reversal development) to use a development liquid having a negative polarity toner. A problem associated with this requirement for both positive and negative images is that a toner mix be provided which has different polarities and which must all be incorporated into the same developing solution. This results in many instances in a deterioration of the image quality resulting from a required mix of such toner. In addition, it is very difficult to get stable developing liquid having a negative polarity toner. This is because of the fact that most colored pigments used for toner such as carbon black and phthalocyanine pigment have a positive polarity.

In addition, most resins which provide negative polarity toner are inconvenient with respect to their inability to properly moisten, especially to obtain a stable dispersive liquid for developing. On the other hand, developing liquid with a positive polarity toner is more easily obtainable. These include, for example, alkyd resins, resin-modified formaldehyde, and in addition, provide good moistening of the pigment and are easily dissolved in a developing liquid.

For the above mentioned reasons, it is desirable that an electrophotosensitive layer be capable of accepting charges of both positive and negative polarity.

OBJECTS OF THE INVENTION

It is an object of this invention to provide a photosensitive material which exhibits the soft tone characteristics suitable for rendering continuous gradation of tone.

It is another object of this invention to provide a photosensitive material suitable for producing images having tonal gradations and suitable for liquid development.

It is a further object of this invention to provide an improved photosensitive zinc oxide material.

SUMMARY OF THE INVENTION

The foregoing objects and others are accomplished in accordance with this invention by providing a method of treating photosensitive zinc oxide in order to enhance its suitability for obtaining improved continuous tone imaging and liquid development. The method comprising distributing conventional photosensitive zinc oxide particles in a distribution promoting liquid agent comprising an aqueous or organic acid solution inclusive of acid solution and an organic solvent comprising methyl or ethyl alcohol; and heat treating the uniformly distributed dried material in the temperature range of about 400° C up to 700° C. More specifically, the method comprises taking conventional zinc oxide powder manufactured for use as a photosensitive material, distributing said zinc oxide uniformly in an acid solution preferably followed by partial drying to form a paste. The paste is then subsequently heat treated in the range of about 400° C up to 700° C, resulting in an improved zinc oxide suitable for use in conventional binder structures in which said zinc oxide is dispersed substantially uniformly in any suitable film-forming organic insulating resin. Such zinc oxide exhibits outstanding properties with respect to tone gradation in continuous tone copying and is particularly suitable for use in systems utilizing liquid development.

DETAILED DESCRIPTION OF THE INVENTION

Figure 1:
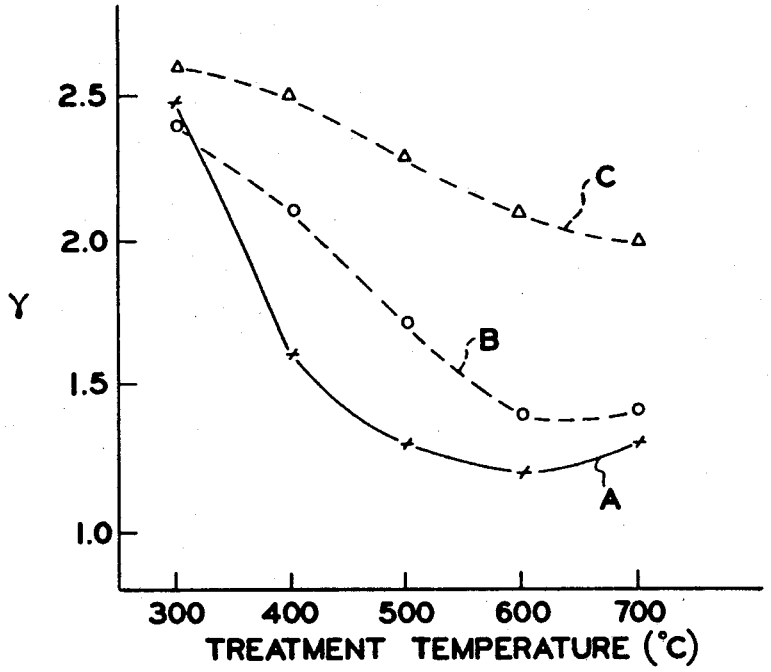

The process of the instant invention comprises treating a conventional photosensitive zinc oxide powder by first moistening the powder in an acid solution with a solvent consisting of mixed solutions of water, or water and methyl alcohol or ethyl alcohol. This treated zinc oxide powder is then heat treated at a temperature in the range of about 400° C up to 700° C. The resulting zinc oxide is particularly suitable for use forming images having continuous gradations of tone and where liquid development is employed. The treated zinc oxide particles are normally used in a resin insulating binder layer in which the zinc oxide particles are dispersed in a film forming insulating organic resin.

More specifically, the process of the instant invention may be divided into the following operations:

Operation I: A conventional photosensitive zinc oxide such as zinc oxide powder manufactured by the gas-phase oxidation process of metallic zinc is uniformly distributed in an acid solution with a solvent water or water-methyl alcohol, or water-ethyl alcohol.

Operation II: The distributed solution prepared in Operation I is now in the form of a paste which is allowed to dry at room temperature until the solvent is substantially dried off.

Operation III: A dried powder or paste is then heat treated in the temperature range of about 400° C to 700° C.

It is well known that zinc oxide powder lends itself to be uniformly dispersed easily in water, methyl alcohol, or ethyl alcohol. It is especially well distributed in a solution of methyl alcohol and ethyl alcohol.

It is well known that zinc oxide powder lends itself to be distributed easily in water, methyl alcohol, or ethyl alcohol, and especially in a solution of methyl alcohol and ethyl alcohol. By means of the Operation I, representing the uniformly distributing method, zinc oxide powder is made to distribute as fine and uniformly pulverized particles. As the distribution promoting liquid agent employed in the Operation I is represented as an acid solution, the way in which the distributing treatment is conducted should necessarily be affected by the concentration of the acid solution, however, the acid strength does not have any significant influence on the distribution of zinc oxide powder.

Operation II need not necessarily be conducted in a separate manner from Operation III. Operation II in fact may be conducted in combination with the Operation III, however, from the standpoint of preferred practice, it is desirable to conduct the Operation II prior to the Operation III. It is noted that with regard to the acid concentration and water mixing ratio of the distribution promotion agent, that absorption quantities of water and acid existing on the surface of the powder subjected to the dry heating process show a remarkable fluctuation. Inasmuch as water, methyl alcohol and ethyl alcohol are easily dissolved in each other, the zinc oxide is easily wetted by water, methyl alcohol and ethyl alcohol to produce a high distributing property, the quantities of water and acid contained in the powder subject to dry-heating process defined in the Operation II are uniformly distributed over the surface of the particle of the powder.

As far as the other liquids are concerned, acetone and other similar liquids are easily dissolved in water and easily dried and accordingly, these liquids are also available for use in the method of the present invention. However, with respect to the property of wetting zinc oxide with great efficiency, methyl alcohol and ethyl alcohol are preferred.

In view of the above, a preferred wetting material comprises a mixture of acidfied water with methyl alcohol and ethyl alcohol. It is extremely difficult to determine accurately the composition range of the wetting bath. This difficulty is attributed to the fact that this particular composition range is heavily affected by the ratio of the weight of the wetting bath of that of zinc oxide to be treated, and also, to the drying conditions. However, at the time of commencement of the Operation III, (i.e. the dried paste) it has been discovered that zinc oxide can retain from 5 to 20 percent by weight of water distributed uniformly over its surface. Upon exceeding this 20 percent water content, (i.e. lack of drying in Operation II) a pronounced deterioration of darkness damping characteristic is observed, and if the water content is driven down lower than 5 percent by extreme measures then a correspondingly lower $\gamma$ value is observed. In case of carrying out the drying operation at a low temperature, it is desirable to use a water content within the range of 7.5 to 20 percent. In general, it may be stated that the water in the wetting material can preferably be present at about 10 percent by weight above the weight of the zinc oxide to be treated. For example, with 100 weight parts of zinc oxide, the wetting bath should be, under normal conditions, above 300 weight parts and below 600 weight parts, however, in case of using 300 weight parts, water should occupy above 10 weight parts and below 100 weight parts of the above. In the case of using 600 weight parts, water should occupy above 10 weight parts and below 200 weight parts of the above.

As methyl alcohol and ethyl alcohol are necessary ingredients for wetting the surface of the particle of zinc oxide, and subsequently forming a paste, they can include up to 50 percent or above, based on the weight of zinc oxide or even the same quantity of water or above that of the weight of zinc oxide. The balance of the content of the wetting material may be composed of other volatile solvents, such as ketone or acetone, methyl ethyl ketone and other suitable chemicals. However, when costs, dry load and other more practical aspects are taken into consideration, it is desirable that more than 80 percent of the wetting material comprise a mixture of water, methyl alcohol or ethyl alcohol, the balance including an acid component.

Acids which are added to the above distribution-promoting medium, include chloric acid, sulfuric acid, nitric acid, and other inorganic acid. Also included are organic acids such as, acetic acid, oxalic acid, formic acid, etc.

In general, the uniform distribution operation is preferably conducted with up to 400 to 500 cc of the distribution-promoting medium for each 100 grams of zinc oxide, the acid component thereof having preferably dissolved at a concentration of about $10^{-4}$ to $10^{-6}$ mol for each gram of zinc oxide. This acid concentration, however, depends largely on the nature of the acid to be employed. Generally speaking, acids of higher strength are added in smaller quantities. For example, when employing a nitric acid, on heat treating at 50° C, the addition of approximately $1 \times 10^{-6}$ mol acid initiates a reducing effect of the $\gamma$ value, a deterioration in the electrification characteristics is noted at approximately $1.5 \times 10^{-5}$ mol concentration leading to a lowered electrification potential with reduced electric charge maintained on the surface of the light-sensitive layer. Also observed is a lowered maintenance rate of the electric charge and also the damping of the electric potential within a short period of time. Under these circumstances, an excessive quantity of added acid is not recommended.

As far as the drying conditions in Operation II, such as the drying temperature, drying time, etc.; these need not be carefully controlled. Temperatures below 150° C, allowing for the proper elimination of the distribution promoting medium, are acceptable.

For the heating treatment Operation III, any kind of the furnace, for instance, electric furnaces and other furnaces may be used. The heat treating temperatures should be maintained above 400° C up to 700° C. In general, heating can be continued for more than 30 minutes in the oxidation atmosphere. As the desirable atmosphere, air or oxygen may be used. When the heating temperature rises above 700° C, however, disturbances are observed in the lattice of the zinc oxide. This lattice disturbed zinc oxide results in lowered sensitivity and electrical characteristics. Further, sintering of zinc oxide becomes pronounced and a difficult problem in the distribution property of the powder. Accordingly, it is preferable to limit the heat treating to a temperature up to 700° C.

The flow of air during the course of the heating operation does not have any significant effect on the final results. This is presumably due to the fact that, the particle diameter of zinc oxide is fairly small and moisture absorbed does not leave from the powderous layer in an easy manner. After the zinc oxide powder treated in the above mentioned manner is mixed with the insulating film forming resin compounding agent and the mixture is made into a coating liquid of a uniformly distributed structure, the light-sensitive material is produced by coating on the supporting body preferably provided with a conductive layer.

Advantages of the light-sensitive material produced in accordance with the present invention are found in the easy manner in which, selection, distributing method and other manufacturing conditions of the resins serving as the compounding agent in its manufacture are practically the same as the case when the ordinary zinc oxide is used and the manufacturing techniques of the latter can be applicable without any noticeable change. Further, the method of extending the range of spectrum sensitivity obtained by adding pigments to the light-sensitive layer can also be applicable to the manufacture of the light-sensitive material embodying the present invention only by proper selection of the quantity of the said additive material.

The distinctive features of the light-sensitive material embodying the present invention are the distinguished darkness damping characteristic and milder gradient of the characteristic curve represented by the light exposure quantity shown on the abscissa and the relative residual potential or developing concentricity on the ordinate, that is to say, power $\gamma$-value. In case of the light-sensitive layer in which zinc oxide is exclusively employed as the photoelectricity conductive powder, the distinguished darkness damping characteristic and lower $\gamma$-value of the characteristic curve could not be achieved in a simultaneous manner, by adopting conventional methods.

Further, even when a method which is similar to that embodying the present invention, without using acid when passing through the Operation I, is employed, this particular method can obtain lower $\gamma$-value as compared with the conventional methods. However, by the method embodying the present invention in which acid is employed in the Operation I, the effect of reducing the $\gamma$-value can further be intensified. The mechanism of reducing the $\gamma$-value is not known to the inventor, however, reduction by 0.1 - 0.05 percent can be obtained as compared with the $\gamma$-value obtained without employing acid. It goes without saying that the reduction of $\gamma$-value depends on nature and quantity of the acid added and the heat treating temperature.

The characteristic of this light-sensitive layer, especially the $\gamma$-value, is affected by the moisture content of the powder at the conclusion of the drying treatment conducted during the course of the Operation III. However, utmost care should be taken in preventing the water content from exceeding 15 percent because of a pronounced reduction of the darkness damping characteristic.

By means of mixing water which is holding acid content in zinc oxide powder prior to the heat treatment, the light-sensitive layer of the lower $\gamma$-value can be obtained. The result in which acid including water is uniformly distributed in zinc oxide in the way as permissible in the present invention is most prohibitingly difficult by the other conventional method in the sense of the technical possibility. Some alternative methods can be considered. For instance, a method to generate a damp and high temperature atmosphere from acid solved water and to treat zinc oxide in the particular atmosphere, or a method to allow acid in a gaseous state as well as water steam to pass through the pulverized powder layer of zinc oxide or a method to allow water steam containing acid in a solved state to pass through the pulverized powder layer of zinc oxide. These methods, however, require complicated techniques and they require a set of special equipment to obtain powder with such uniform distribution of water content as permissible to the method embodying the present invention and the whole set of instrumentation becomes also extremely complicated when compared with the equipment required by the method embodying the present invention. On the other hand, the method embodying the present invention posseses a distinct advantage with respect to the availability of obtaining uniformly distributed water content all over the powder layer by a comparatively simple method.

It has been found that if the heat temperature prescribed in the Operation III is omitted and only the drying treatment is performed in the Operation II, the light-sensitive layer of low $\gamma$-value cannot be obtained regardless of the uniformity with which water including acid is distributed in the zinc oxide layer.

DESCRIPTION OF THE PREFERRED EMBODIMENTS

The following examples further specifically define the present invention with respect to a method of making a photosensitive binder layer containing zinc oxide which exhibits soft tone characteristics. The percentages in the specifications, examples and claims are by weight unless otherwise indicated. The examples below are intended to illustrate various preferred embodiments of the instant invention.

EXAMPLE 1

A uniform distribution of zinc oxide suitable for the appropriate heat treatment is prepared as follows: a mixture of zinc oxide powder (sakai-kagaku, Sazex 2000) 200 parts by weight is mixed with 200 parts by weight of water and 500 parts by weight of methyl alcohol. A solution is prepared by dissolving with $5 \times 10^{-6}$ mol oxalic acid per one gram of zinc oxide by appling supersonic wave projection for complete mixing and distribution of the zinc oxide powder in said solution.

The solution is dried by the following technique: the solution is subject to a separation operate by means of a centrifigal separating machine of obtain a pasty substance consisting of zinc oxide powder and distribution promoting medium and the pasty substance thus obtained is allowed to dry at 50° C constant temperature for approximately 16 hours.

The dried powder is then heated at a rate of 4° C per minute in a muffle-type electric oven, and maintained at temperatures of 300° C, 400° C, 500° C, 600° C, and 700° C for 2 hours each respectively, in a still air atmosphere.

100 parts by weight of this treated powder is mixed with 60 parts by weight of styrated alkyd resin varnish (Japan - Reichhold manufactured, Styresol 400) and 40 parts by weight of polyisocynate compound solution (Bayer manufactured, Desmodule L). The following ingredients are added to this mixture in order to import enhanced sensitivity: 0.02 parts by weight edible blue No. 1, 0.04 parts by weight of Eosine and 0.05 parts by weight of Fluoresceine which are all diluted with 4 parts by weight of methyl alcohol and 130 parts by weight of butyl acetate and added to make a coating liquid by agitating the entire mixture for 30 minutes in a homogenizing agitating machine.

The coating solution is flow coated over a PET film containing a vapor deposited aluminum layer in a thickness of 5–6 microns after the coated film is dried.

The PET film is available under the tradename "Metalmie" manufactured by Toyo Rayon. This coated film is dried at a temperature of 50° C for 16 hours.

The light sensitive material thus obtained is allowed to remain in a dark room for two days and nights to be adapted to darkness. The material is then given an electrostatic charge with negative corona and the dark damping characteristics measured. In a second test, a test piece was cut into several pieces and using a light source of an incandescent tungsten filament lamp, light beams of different luminosities were prepared and these beams projected against the electrostatically charged sensitive material in order to determine the light damping characteristics. The electric potential after seven seconds of constant light exposure in a certain luminosity I for the light source damping curves obtained in the above manner is defined as $V_L$. The electric component prior to light exposure is $V_o$, the electric component potential at the time of measurement of darkness damping characteristic is $V_o'$, and the electric potential after seconds of darkness napping as $V_D$ and $V_L/V_o \div V_D/V_o' \times 100$ as the electric potential residual ratio and thus a characteristic curve is drawn by plotting the electric potential residual ratio on the ordinate and a value which is corresponding to log 1/It on the abscissa. The ordinate scale is selected so that it shows 100 percent of the value of log (1/It) = 2.0. A pair of parallel lines with the width of 0.1 on the log 1/It scale is extended to intersect the characteristic curve and the angle thus obtained of the parallel lines is defined as the value of $\gamma$. Values of the light sensitive layer with respect to that of the heat treatment temperature are shown in FIG. 1 to represent their changes. On this particular graphical representation, the following curves are represented: a curve showing the changes in the value of $\gamma$ of the light sensitive layer employing zinc oxide powder subjected to the treatment embodying the present invention (Curve A); a curve showing the changes in the value of $\gamma$ of the light sensitive layer employing zinc oxide powder treated without adding acid (Curve B); further, a curve showing the changes of the value of 65 of the light sensitive layer employing zinc oxide powder is subjected only to the treatment of the untreated powder (Curve C). These three curves are consolidated in FIG. 1 for comparison. The Figure represents that Curve C is located above Curve B showing a more pronounced effect on the part of the method in which the acid was not added in recognized at first glance, however, in Curve A representing the treatment method embodying the present invention, even better effect is obtained, as is clearly illustrated by the Figure.

EXAMPLE 2

A treating mixture containing zinc oxide is prepared as follows. 200 parts by weight of zinc oxide powder (Sakai Chemical, Sazex 2000) is mixed with 150 parts water and 520 methyl alcohol with chloric acid being added at the rate of 0.3 times $10^{-5}$ mol, $0.75 \times 10^{-5}$ mol and $1 \times 10^{-5}$ mol per one gram of zinc oxide and the same uniform distributing treatment as carried out in Example 1 was performed for each individual mixture. The liquids subjected to this distribution treatment may be treated for drying the same way as set forth in Example 1. The dried powder obtained by the process of Example 1 is then subjected to heat treatment lasting for 2 hours at a temperature of 500° C. The light sensitive material was manufactured under the same conditions as set forth in Example 1, employing the powder as prepared in the above manner and the measurements were carried out with respect to the characteristic curves. The distinctive characteristics of this particular light sensitive material was measured and graphically represented in FIG. 2.

Figure 2:
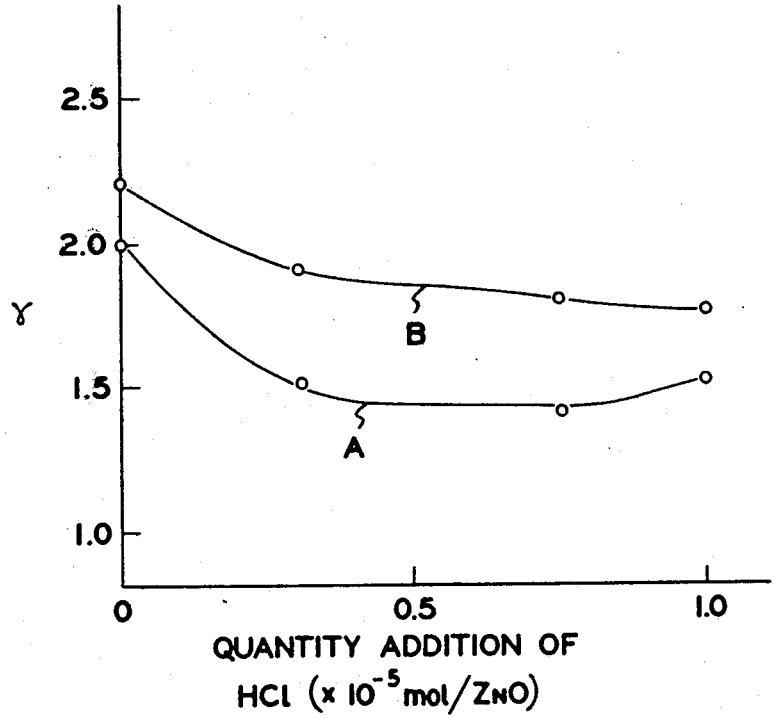

As set forth in FIG. 2 for the light sensitive layer of Example 2, the value of $\gamma$ shows decreasing tendency in conjunction with the increasing quantity of the additional light sensitive promoting pigment. This is an apparent manifestation that addition of acid affords a stronger influence on the decreasing tendency of the value of $\gamma$ in comparison with the case where no addition of acid is made.

Other modifications and ramifications of the present invention appear to those skilled in the art upon reading the disclosure. These are also intended to be within the scope of this invention.

What is claimed is:

1. A method of treating photosensitive zinc oxide to enhance its suitability for obtaining improved continous tone imaging and liquid development, comprising dispersing photosensitive zinc oxide particles uniformly in a distribution promoting liquid agent containing at least one of chloric acid, nitric acid, acetic acid, oxalic acid or formic acid applied in a concentration of about $10^{-4}$ to $10^{-6}$ mole of acid per gram of zinc oxide; and heat treating the uniformly dispersed and dried material in a temperature range of about 400° C. up to 700° C.

2. The method of claim 1 in which moistened zinc oxide powder is dried as a paste prior to the heat treating step.

3. The method of claim 1 in which zinc oxide is distributed in a distribution promotion agent comprising water, acid and at least one member selected from the group consisting of acetone, methyl alcohol and ethyl alcohol.

4. The method of claim 2 wherein the paste is allowed to dry at room temperature until the solvent in the distribution promotion agent is substantially dried off prior to the heat treating step.

5. The method of claim 4 wherein the water content of the moistened zinc oxide paste is within the range of 7.5 to 20% by weight based on zinc oxide.

* * * * *